US011932510B2

(12) United States Patent
Nitta et al.

(10) Patent No.: US 11,932,510 B2
(45) Date of Patent: Mar. 19, 2024

(54) SHEET FEEDING APPARATUS AND IMAGE FORMING APPARATUS

(71) Applicant: CANON KABUSHIKI KAISHA, Tokyo (JP)

(72) Inventors: Jumpei Nitta, Kanagawa (JP); Kazuhiro Hosohara, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 140 days.

(21) Appl. No.: 17/365,258

(22) Filed: Jul. 1, 2021

(65) Prior Publication Data

US 2022/0009735 A1 Jan. 13, 2022

(30) Foreign Application Priority Data

Jul. 13, 2020 (JP) ..... 2020-119987

(51) Int. Cl.

| | |
|---|---|
| ***B65H 5/38*** | (2006.01) |
| ***B65H 3/06*** | (2006.01) |
| ***B65H 3/66*** | (2006.01) |
| ***B65H 5/06*** | (2006.01) |

(52) U.S. Cl.

CPC ..... *B65H 5/38* (2013.01); *B65H 3/0676* (2013.01); *B65H 3/66* (2013.01); *B65H 5/062* (2013.01)

(58) Field of Classification Search

CPC ..... B65H 5/062; B65H 5/38; B65H 2407/21; B65H 2405/332; B65H 3/0676

See application file for complete search history.

(56) References Cited

U.S. PATENT DOCUMENTS

| | | | | |
|---|---|---|---|---|
| 4,113,244 | A * | 9/1978 | Ruenzi | B65H 7/12 271/225 |
| 5,545,882 | A * | 8/1996 | Tanaka | G06M 7/06 235/98 R |
| 9,938,097 | B2 | 4/2018 | Murakami | |
| 2006/0285904 | A1* | 12/2006 | Yoshida | G03G 15/6511 399/401 |
| 2008/0157459 | A1* | 7/2008 | Terashima | B65H 3/0661 271/226 |
| 2012/0025453 | A1* | 2/2012 | Yamaguchi | B65H 5/062 271/225 |
| 2012/0051818 | A1* | 3/2012 | Yamaguchi | B65H 3/5261 399/397 |

FOREIGN PATENT DOCUMENTS

| | | |
|---|---|---|
| JP | 2015054728 A | 3/2015 |
| JP | 2016040195 A | 3/2016 |
| JP | 2016222439 A | 12/2016 |

* cited by examiner

*Primary Examiner* — Jennifer Bahls

(74) *Attorney, Agent, or Firm* — ROSSI, KIMMS & McDOWELL LLP

(57) ABSTRACT

A sheet feeding apparatus includes a sheet supporting portion configured to support a sheet, a feed rotary member configured to feed the sheet supported by the sheet supporting portion, a curved conveyance path through which the sheet fed by the feed rotary member passes and which is curved upward, an upper conveyance path disposed above the sheet supporting portion so as to pass through a sheet and configured to join with the curved conveyance path, and a driven rotary member disposed inside of the curved conveyance path in a curved direction thereof and driven to rotate by the sheet passing though the curved conveyance path.

11 Claims, 8 Drawing Sheets

SHEET FEEDING APPARATUS AND IMAGE FORMING APPARATUS

BACKGROUND OF THE INVENTION

Field of the Invention

The present invention relates to a sheet feeding apparatus and an image forming apparatus including the same.

Description of the Related Art

Hitherto, an image forming apparatus configured to form a toner image onto a sheet fed from a sheet feed cassette has been proposed as disclosed in Japanese Patent Application Laid-Open No. 2016-222439 for example. This image forming apparatus includes a manual feed portion configured to manually feed a sheet. The sheet fed from the manual feed portion passes through a conveyance path disposed above the sheet feed cassette and joins with a conveyance path through which a sheet fed from the sheet feed cassette passes through. Then, the sheet is conveyed upward by a separation nip portion composed of a feed roller and a retard roller.

In the image forming apparatus described in Japanese Patent Application Laid-Open No. 2016-222439, the sheet nipped by the separation nip portion is conveyed along a curved conveyance path curved upward. However, in a case of conveying a sheet such as a stiff thick sheet for example, a conveyance resistance increases when such sheet passes through the curved conveyance path.

SUMMARY OF THE INVENTION

According to a first aspect of the present invention, a sheet feeding apparatus includes a sheet supporting portion configured to support a sheet, a feed rotary member configured to feed the sheet supported by the sheet supporting portion, a curved conveyance path through which the sheet fed by the feed rotary member passes and which is curved upward, an upper conveyance path disposed above the sheet supporting portion so as to pass through a sheet and configured to join with the curved conveyance path, and a driven rotary member disposed inside of the curved conveyance path in a curved direction thereof and driven to rotate by the sheet passing though the curved conveyance path.

According to a second aspect of the present invention, a sheet feeding apparatus includes a sheet supporting portion configured to support a sheet, a feed rotary member configured to feed the sheet supported by the sheet supporting portion, a conveyance rotary member configured to convey the sheet fed by the feed rotary member, a first conveyance path through which the sheet fed by the feed rotary member passes through, a second conveyance path disposed above the sheet supporting portion such that a sheet passes through and configured to join with the first conveyance path, a first driven rotary member driven to rotate by the sheet passing through the second conveyance path, and a second driven rotary member disposed on a side opposite to the first driven rotary member across the conveyance rotary member in a rotation axial direction of the feed rotary member and driven to rotate by the sheet passing through the second conveyance path, wherein each of outer diameters of the first and second driven rotary members is smaller than an outer diameter of the conveyance rotary member.

Further features of the present invention will become apparent from the following description of exemplary embodiments with reference to the attached drawings.

DESCRIPTION OF THE EMBODIMENTS

First Exemplary Embodiment

Overall Configuration

Figure 1:
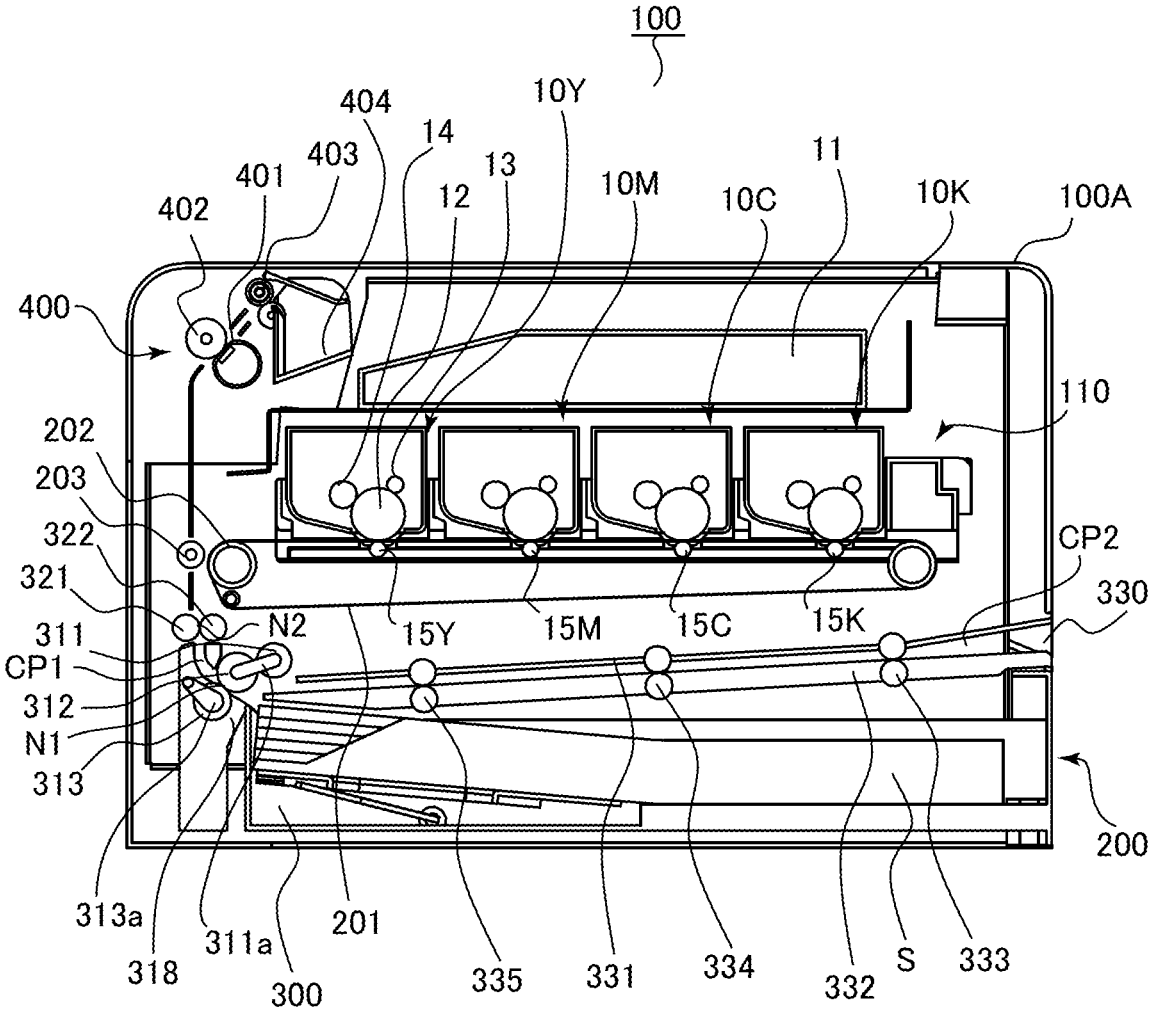
FIG. 1 is a schematic diagram illustrating an overall configuration of a printer of a first exemplary embodiment.

Firstly, a printer 100 of the first exemplary embodiment of the present disclosure will be described. The printer 100 serving as an image forming apparatus is an electro-photographic full-color laser beam printer. As illustrated in FIG. 1, the printer 100 includes an image forming unit 110 configured to form an image onto a sheet S, a sheet feeding apparatus 200 and a fixing unit 400. The printer 100 includes four process cartridges 10Y, 10M, 10C and 10K respectively forming four color toner images of yellow (Y), magenta (M), cyan (C) and black (K) and a laser scanner 11.

Note that configurations of the four process cartridges 10Y, 10M, 10C and 10K are the same other than that the colors to be formed are different. Therefore, only the configuration of the process cartridge 10Y and its image forming process will be described below and description of the other process cartridges 10M, 10C and 10K will be omitted here.

The process cartridge 10Y includes a photosensitive drum 12, a charging roller 13 and a developing roller 14. The photosensitive drum 12 is constructed by an aluminum cylinder around which an organic photoconductive layer is applied and is rotated by a driving motor not illustrated. Note that a photosensitive belt may be used instead of the photosensitive drum 12. The image forming unit 110 is also provided with an intermediate transfer belt 201 which is wrapped around a driving roller 202 and others and which is rotated clockwise by the driving roller 202 in FIG. 1. Provided inside of the intermediate transfer belt 201 are primary transfer rollers 15Y, 15M, 15C and 15K.

The fixing unit 400 includes a fixing film 401 configured to be heated by a heater and a pressure roller 402 brought into contact with the fixing film 401. The sheet feeding apparatus 200 is provided at a lower part of the printer 100 and includes a sheet feed cassette 300 serving as a drawer portion drawable/attachable from/to a printer 100A serving as an apparatus body. The sheet feeding apparatus 200 also includes a manual feed port 330 through which a sheet is manually inserted.

Next, the image forming operation of the printer 100 constructed as described above will be described. As an image signal is inputted to the laser scanner 11 from a personal computer or the like not illustrated, a laser beam corresponding to the image signal is irradiated from the laser scanner 11 onto the photosensitive drum 12 of the process cartridge 10Y.

At this time, a surface of the photosensitive drum 12 is charged by a charging roller 13 in advance homogeneously at predetermined polarity and potential, and as the laser beam is irradiated from the laser scanner 11, an electrostatic latent image is formed on the surface of the photosensitive drum 12. The electrostatic latent image formed on the photosensitive drum 12 is developed by a developing roller 14, and a yellow toner image (Y) is formed on the photosensitive drum 12.

In the same manner, the laser beam is irradiated from the laser scanner 11 to the respective photosensitive drums of the process cartridges 10M, 10C and 10K, and toner images of magenta (M), cyan (C) and black (K) are formed on the respective photosensitive drums. The toner images of the respective colors formed on the respective photosensitive drums are transferred onto the intermediate transfer belt 201 by primary transfer rollers 15Y, 15M, 15C and 15K and are conveyed to a secondary transfer roller 203 by the intermediate transfer belt 201 rotated by the driving roller 202.

It is noted that the image forming processes of the respective colors are conducted with timing of superimposing the toner images onto an upstream toner image primarily transferred onto the intermediate transfer belt 201. After transferring the toner images of the respective colors onto the intermediate transfer belt 201, toner left on the surface of the photosensitive drum 12 is removed by a cleaning unit not illustrated.

In parallel with this image forming process, the sheet S stored in the sheet feed cassette 300 or a sheet supplied from the manual feed port 330 of the sheet feeding apparatus 200 is conveyed toward a nip N2 of a pair of conveyance rollers 321 and 322. It is noted that the pair of conveyance rollers 321 and 322 may be composed of a registration roller pair configured to correct a skew of the sheet and to convey the sheet with a predetermined conveyance timing synchronized with the image forming process. Or, a registration shutter may be provided upstream of the pair of conveyance rollers 321 and 322 such that a leading edge of the sheet butts to correct a skew.

The full color toner image on the intermediate transfer belt 201 is transferred onto the sheet S conveyed by the pair of conveyance rollers 321 and 322 by a secondary transfer bias applied to the secondary transfer roller 203. The sheet S onto which the toner image has been transferred is then conveyed to the fixing unit 400 to undergo predetermine heat and pressure from the fixing film 401 and the pressure roller 402 of the fixing unit 400 to melt and secure, i.e., fix, the toner. The sheet S which has passed through the fixing unit 400 is discharged out to a discharge tray 404 by a discharge roller pair 403.

Sheet Feeding Apparatus

Next, the configuration of the sheet feeding apparatus 200 will be described in detail with reference to FIGS. 1 and 2. It is noted that the sheet stored in the sheet feed cassette 300 will be denoted as a sheet S1 and the sheet inserted through the manual feed port 330 will be denoted as a sheet S2 hereinafter.

Figure 2:
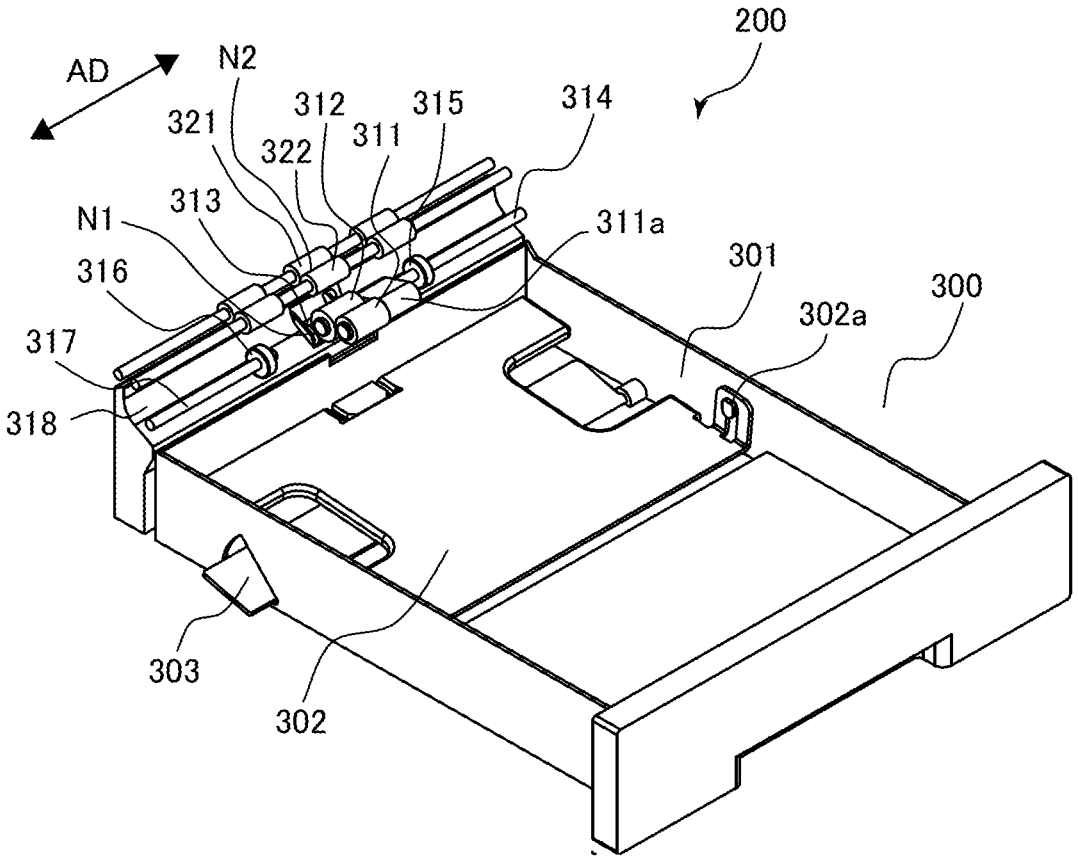
FIG. 2 is a perspective view illustrating a sheet feeding apparatus of the first exemplary embodiment.

As illustrated in FIGS. 1 and 2, the sheet feeding apparatus 200 includes the sheet feed cassette 300, a pickup roller 311, a swing arm 311*a* swingably supporting the pickup roller 311, a feed roller 312 and a separation roller 313.

The sheet feed cassette 300 includes a cassette frame 301 configured to store the sheet S1, a sheet stacking plate 302 supported pivotably around a pivot shaft 302*a* and a lift arm 303 for pivoting the sheet stacking plate 302. The sheet feed cassette 300 is inserted into the printer body 100A from a front side of the printer 100.

The sheet S1 is loaded on the sheet stacking plate 302 serving as a sheet supporting portion which is then inserted into the cassette frame 301 by a user. The sheet stacking plate 302 is lifted around the pivot shaft 302*a* as the lift arm 303 driven by a driving source not illustrated swings. As a printing job starts, the lift arm 303 is controlled such that an uppermost sheet S1 stacked on the sheet stacking plate 302 is kept at a predetermined height.

The feed roller 312 serving as a conveyance rotary member is fixed to one end of a feed roller shaft 314 driven by a feed motor not illustrated. A swing arm 311*a* is swingably supported by the feed roller shaft 314, and the pickup roller 311 is rotatably supported at a tip of the swing arm 311*a*. It is noted that the swing arm 311*a* is provided with a drive train not illustrated and transmitting rotations of the feed roller shaft 314 to the pickup roller 311.

Figure 3:
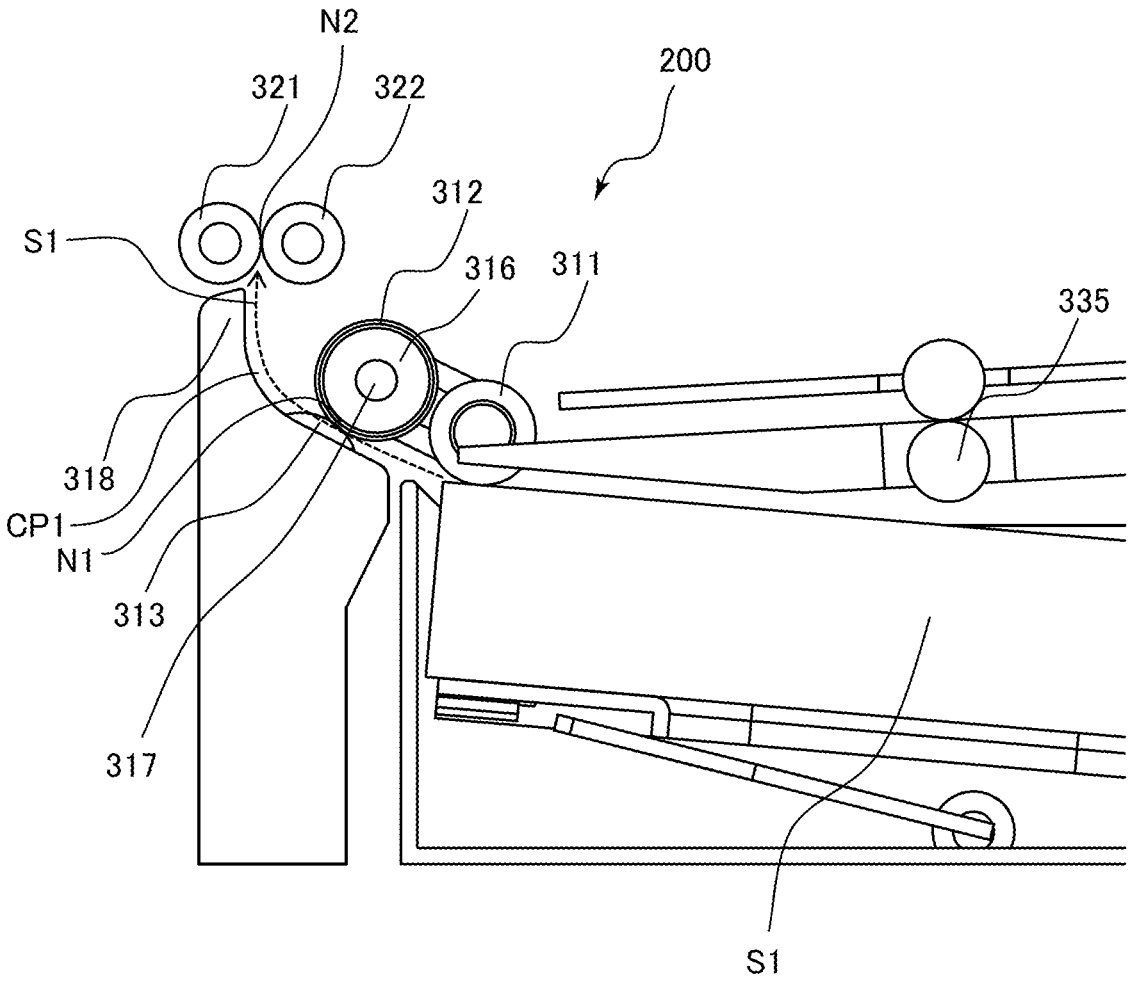
FIG. 3 is a side view illustrating a state in which a sheet is fed from a sheet feed cassette.

The pickup roller 311 serving as a feed rotary member is liftable by the swing arm 311*a* between an abutment position where the pickup roller 311 abuts with the uppermost sheet S1 on the sheet stacking plate 302 and a separate position where the pickup roller 311 separates from the sheet S1. That is, the pickup roller 311 is provided swingably around the feed roller shaft 314 serving as a rotary axis between the abutment position and the separate position. The pickup roller 311 conveys the sheet S1 toward a curved conveyance path CP1 where the sheet S1 is curved upward as illustrated in FIG. 3 by rotating while being positioned at the abutment position. The curved conveyance path CP1 serving as a first conveyance path is formed by a sheet guide 318 that is curved upward toward a downstream side in a sheet conveyance direction. The sheet guide 318 serving as a curved guide member is in contact with a lower surface of the sheet and guides the sheet upward.

The separation roller 313 forms a nip N1 together with the feed roller 312, and the sheet S1 fed from the sheet feed cassette 300 by the pickup roller 311 is separated one by one by the nip N1 serving as a separating portion.

A torque limiter not illustrated is attached to the separation roller 313. In a case where two or more sheets enter the nip N1, the separation roller 313 does not rotate and in a case where one sheet enters the nip N1, the separation roller 313 is driven by the feed roller 312. It is noted that a so-called retard roller system of inputting a rotational drive in an opposite direction from the sheet conveyance direction may be adopted for the separation roller 313. It is also possible to arrange such the sheets can be separated one by one at the curved conveyance path CP1 by a separation pad or a separation slope.

Meanwhile, the sheet S2 (see FIG. 4) manually inserted through the manual feed port 330 is guided along a manual conveyance path CP2 formed by a manual upper guide 331 serving as a first guide member and a manual lower guide 332 serving as a second guide member. The manual conveyance path CP2 serving as an upper conveyance path and as a second conveyance path is disposed above the sheet feed cassette 300 such that the sheet S2 can pass through. Manual conveyance roller pairs 333, 334 and 335 are provided along the manual conveyance path CP2, and the sheet S2 is conveyed by these manual conveyance roller pairs 333, 334 and 335. The manual conveyance path CP2 joins with the curved conveyance path CP1. Then, the sheet S2 passes through the manual conveyance path CP2 and the curved conveyance path CP1 and is conveyed toward the secondary transfer roller 203 by the nip N2 formed by pair of conveyance rollers 321 and 322.

Here, the pickup roller 311 is positioned at the separate position where the pickup roller 311 separates from the sheet S1 during a manual feed operation of feeding the sheet S2 from the manual feed port 330, so that the pickup roller 311 will not hamper the sheet S2 passing through the manual conveyance path CP2. That is, the sheet S2 conveyed through the manual conveyance path CP2 passes between the pickup roller 311 positioned at the separate position and the sheet S1 supported on the sheet stacking plate 302.

Still further, the separation roller 313 is swingably supported by a separation arm 313*a* as illustrated in FIG. 1, and is separated from the feed roller 312 during the manual feed operation. Therefore, the sheet S2 is conveyed toward the nip N2 formed by the pair of conveyance rollers 321 and 322 without being nipped by the feed roller 312 and the separation roller 313.

Conveyance Roller

Here, the conveyance rollers 315 and 316 which are the main part of the present disclosure will be described. As illustrated in FIG. 2, the conveyance roller 315 serving as a driven rotary member and as a first driven rotary member is rotatably supported by the feed roller shaft 314. Still further, a shaft 317 is provided coaxially with the feed roller shaft 314 and on a side opposite to the feed roller shaft 314 across the feed roller 312 in an axial direction AD of the pickup roller 311. The conveyance roller 316 serving as a second driven rotary member is rotatably supported by the shaft 317. That is, the feed roller 312, the conveyance rollers 315 and 316 are disposed coaxially. It is noted that the conveyance rollers 315 and 316 are provided immovably in the axial direction AD serving as a rotary shaft direction by an E-ring, peripheral guide members and others.

Figure 5:
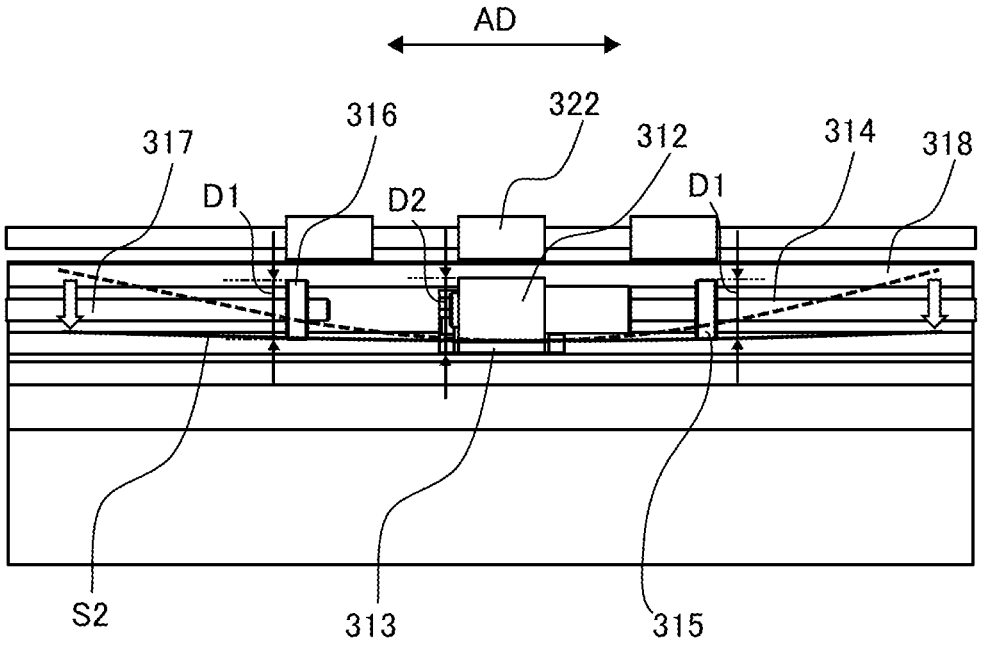
FIG. 5 illustrates a state in which deformation of a sheet passing through a curved conveyance path is corrected.

The conveyance rollers 315 and 316 are disposed approximately symmetrically about the feed roller 312 in the axial direction AD and are disposed inside of the curved conveyance path CP1 in a curved direction thereof. Still further, each of outer diameters D1 of the conveyance rollers 315 and 316 is set to be smaller than an outer diameter D2 of the feed roller 312 as illustrated in FIG. 5.

In a case where the sheet S1 is fed from the sheet feed cassette 300, the sheet S1 is guided upward while being bent along the sheet guide 318 as illustrated in FIG. 3. At this time, an upper surface of the sheet S1 passing through the curved conveyance path CP1 comes into contact with the feed roller 312 and the conveyance rollers 315 and 316.

Because the conveyance rollers 315 and 316 are supported respectively and rotatably by the feed roller shaft 314 and the shaft 317, they are driven by the sheet S1 being conveyed. Due to that, as compared to a case where the upper surface of the sheet S1 comes into slidable contact with a fixed guide member for example, it is possible to reduce a conveyance resistance of the sheet S1 being conveyed through the curved conveyance path CP1. Accordingly, it is possible to downsize and to cut cost of the feed motor driving the feed roller shaft 314 for example.

Figure 4:
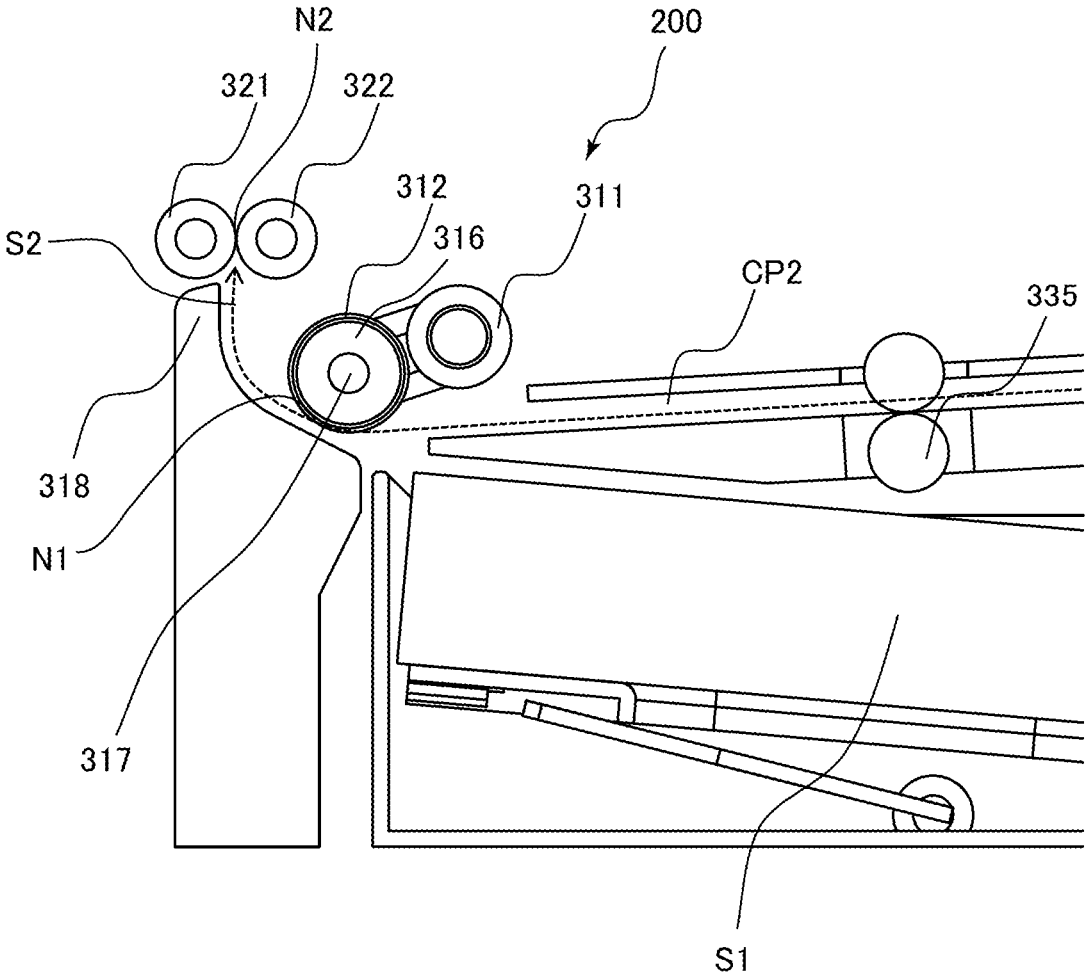
FIG. 4 is a side view illustrating a state in which a sheet is fed from a manual sheet conveyance path.

Next, as illustrated in FIG. 4, the sheet S2 is conveyed along the manual conveyance path CP2 during the manual feed operation. The manual conveyance path CP2 is inclined downward toward a downstream side in the sheet conveyance direction, and the sheet S2 that has passed through the manual conveyance path CP2 is guided upward while being bent along the sheet guide 318. At this time, because the manual conveyance path CP2 is inclined downward, the sheet S2 is bent with a small radius of curvature as compared to the sheet S1 fed from the sheet feed cassette 300, and there is a possibility the sheet S2 generates a greater conveyance resistance.

For instance, in a case where no conveyance rollers 315 and 316 are provided, the sheet S2 being conveyed is deformed into a letter of V with a lowest point at a contact point with the feed roller 312. The sheet S2 thus deformed in a sheet thickness direction when viewed in the sheet conveyance direction hardly deforms in the sheet thickness direction when viewed in the axial direction. That is, the sheet S2 deformed into the shape of V becomes hard to be guided upward by the sheet guide 318 and there is a possibility of generating the large conveyance resistance. Still further, because the lowest point of the sheet S2 formed into the shape of V comes locally into contact with the sheet guide 318, there is a possibility that a leading edge of the sheet S is damaged.

However, as illustrated in FIG. 5, the sheet S2 passing through the curved conveyance path CP1 comes into contact with the conveyance rollers 315 and 316 disposed on both outer sides of the feed roller 312 in the axial direction AD, and the conveyance rollers 315 and 316 are driven to rotate by the sheet S2. Then, because each of the outer diameters D1 of the conveyance rollers 315 and 316 is set to be smaller than the outer diameter D2 of the feed roller 312, the sheet S2 is deformed moderately into a shape of V with the lowest point of the contact point with the feed roller 312. The deformation in the shape of V of the sheet S2 is thus corrected. Therefore, the sheet S2 can be readily bent upward along the sheet guide 318 with starting points of the conveyance rollers 315 and 316, and the conveyance resistance of the sheet S2 can be reduced. Still further, the leading edge of the sheet S2 does not come locally into contact with the sheet guide 318, so that the damage to the sheet S2 can be reduced.

The following effects are brought about by constructing as described above. According the present exemplary embodiment, the pickup roller 311 and the feed roller 312 are formed relatively shortly as compared to a width of the conveyance path in the axial direction AD to cut cost. The radius of curvature of the curved conveyance path CP1 is also reduced to meet with a demand for downsizing the printer 100.

Thereby, a conveyance resistance of a highly stiff sheet such as a thick sheet in particular tends to increase in passing through the curved conveyance path CP1. However, because the upper surface of the sheets S1 and S2 passing through the curved conveyance path CP1 come into contact not only with the feed roller 312 but also with the conveyance rollers 315 and 316, the conveyance resistance of the sheets can be effectively reduced while cutting the cost and downsizing the 100. It is also possible to suppress the leading edge of the sheet S2 from coming locally into contact with the sheet guide 318 and to reduce the damage otherwise caused on the sheet S2.

Second Exemplary Embodiment

Next, a sheet feeding apparatus of a second exemplary embodiment of the present disclosure will be described below. The second exemplary embodiment is constructed by providing movable members 385 and 386 in addition to the configuration of the first exemplary embodiment. Therefore, the same configuration with the first exemplary embodiment will not be illustrated or will be described while denoting the same reference signs.

Sheet Feeding Apparatus

Figure 6:
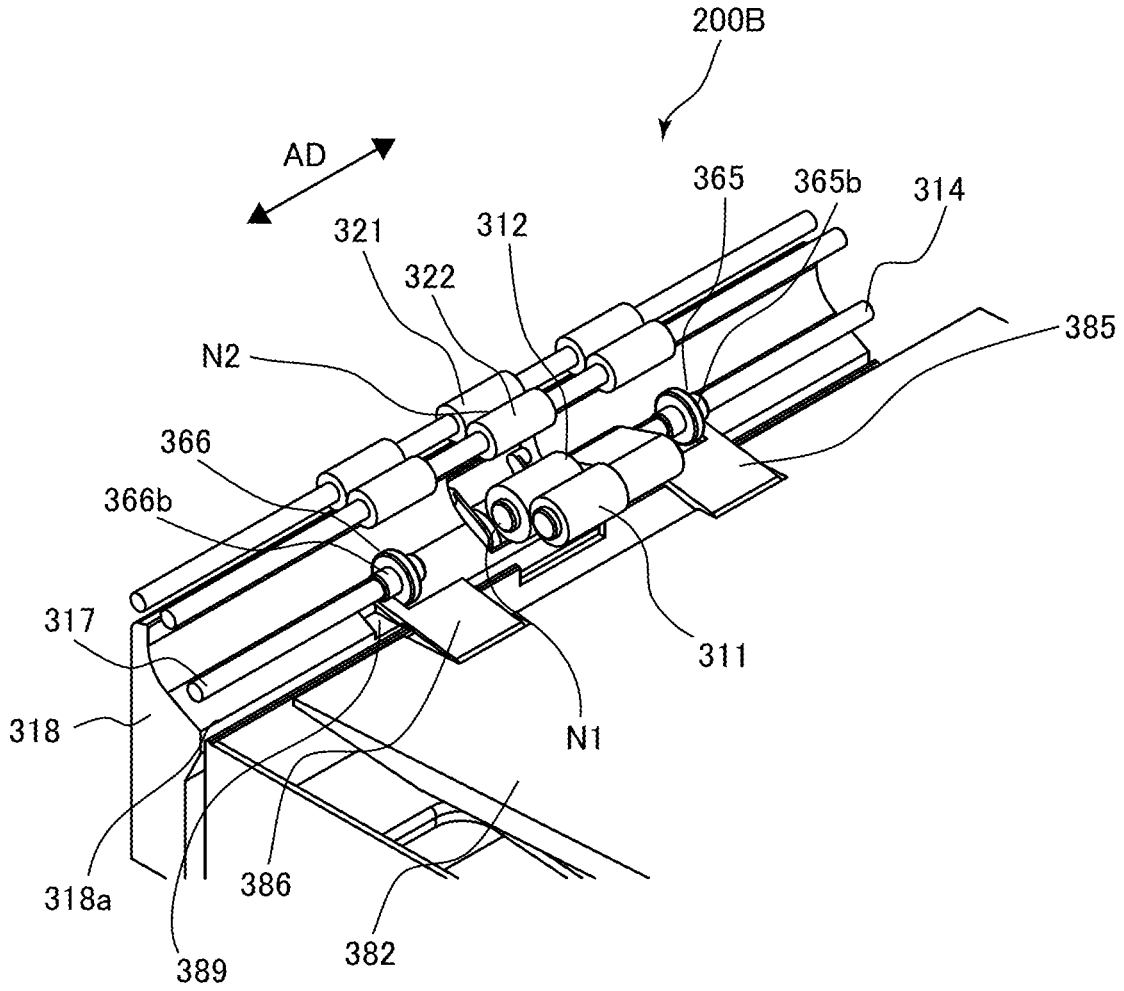
FIG. 6 is a perspective view illustrating a sheet feeding apparatus according to a second exemplary embodiment.

As illustrated in FIG. 6, a sheet feeding apparatus 200B of the second exemplary embodiment includes conveyance rollers 365 and 366. The conveyance roller 365 serving as a driven rotary member and as a first driven rotary member is rotatably supported by the feed roller shaft 314, and the conveyance roller 366 serving as a second driven rotary member is rotatably supported by the shaft 317. That is, the feed roller 312, the conveyance rollers 365 and 366 are disposed coaxially. It is noted that the conveyance rollers 365 and 366 are provided immovably in the axial direction AD by an E-ring, peripheral guide members and others for example.

The conveyance rollers 365 and 366 are disposed approximately symmetrically about the feed roller 312 in the axial direction AD and are disposed inside of the curved direction of the curved conveyance path CP1. Still further, outer diameters D1 of the conveyance rollers 365 and 366 are set to be equal with the conveyance rollers 315 and 316 of the first exemplary embodiment and to be smaller than the outer diameter D2 of the feed roller 312.

Then, because the upper surfaces of the sheets S1 and S2 passing through the curved conveyance path CP1 come into contact not only with the feed roller 312 but also with the conveyance rollers 365 and 366, a conveyance resistance of the sheet can be reduced in the same manner with the first exemplary embodiment.

The conveyance roller 365 is provided with an abutment boss 365*b* formed integrally with the conveyance roller 365 and having an outer diameter D3 (see FIG. 7) smaller than the outer diameter D1. In the same manner, the conveyance roller 366 is also provided with an abutment boss 366*b* formed integrally with the conveyance roller 366 and having an outer diameter D3.

Movable Member

Figure 7:
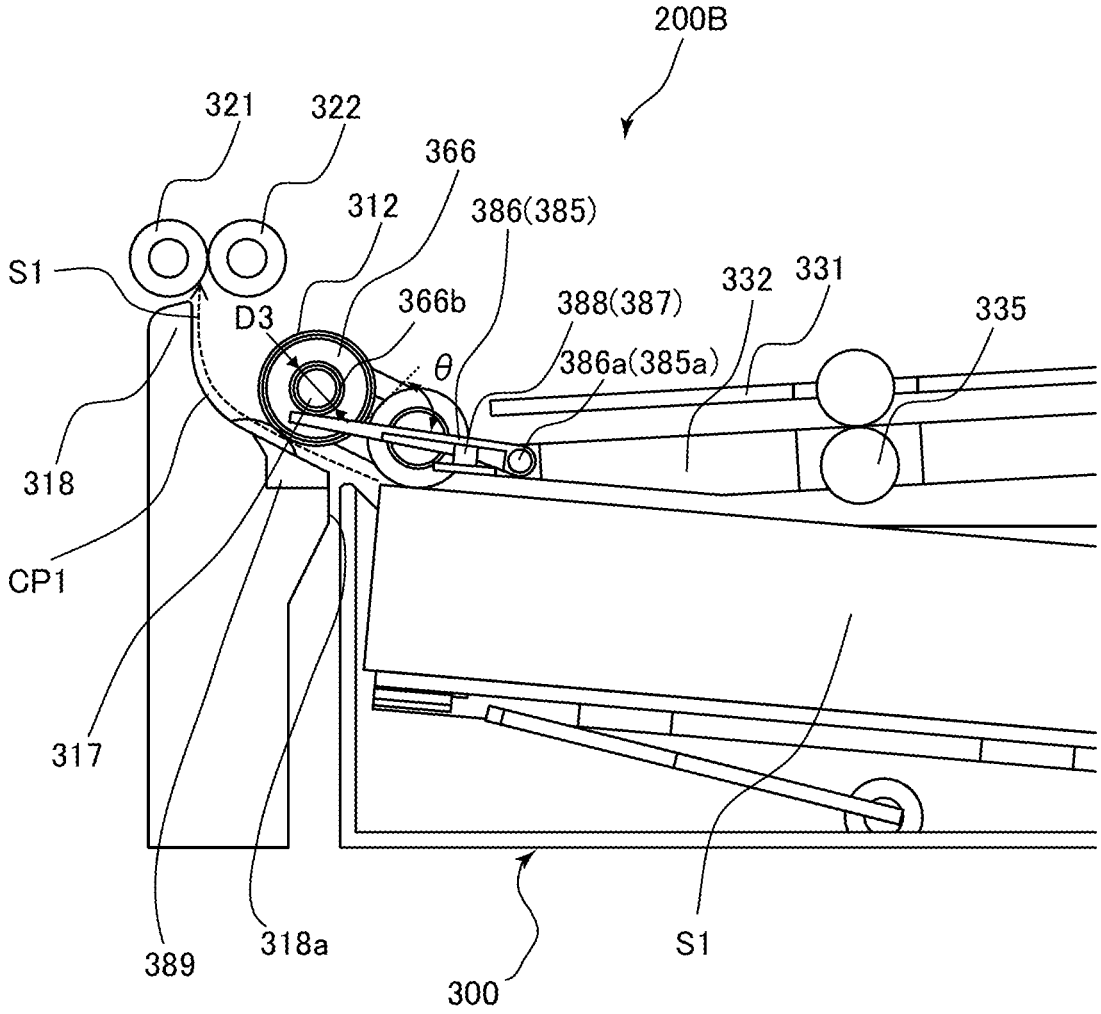
FIG. 7 is a side view illustrating a state in which a sheet is fed from a sheet feed cassette of the second exemplary embodiment.

As illustrated in FIGS. 6 and 7, movable members 385 and 386 serving as connection guides are pivotably supported around on pivot shafts 385*a* and 386*a* by the manual lower guide 332 movably supports respectively. The movable member 386 is disposed on a side opposite to the movable member 385 across the feed roller 312 in the axial direction AD. The movable members 385 and 386 extend downstream of an upstream end 318*a* of the sheet guide 318 in the sheet conveyance direction.

Figure 8:
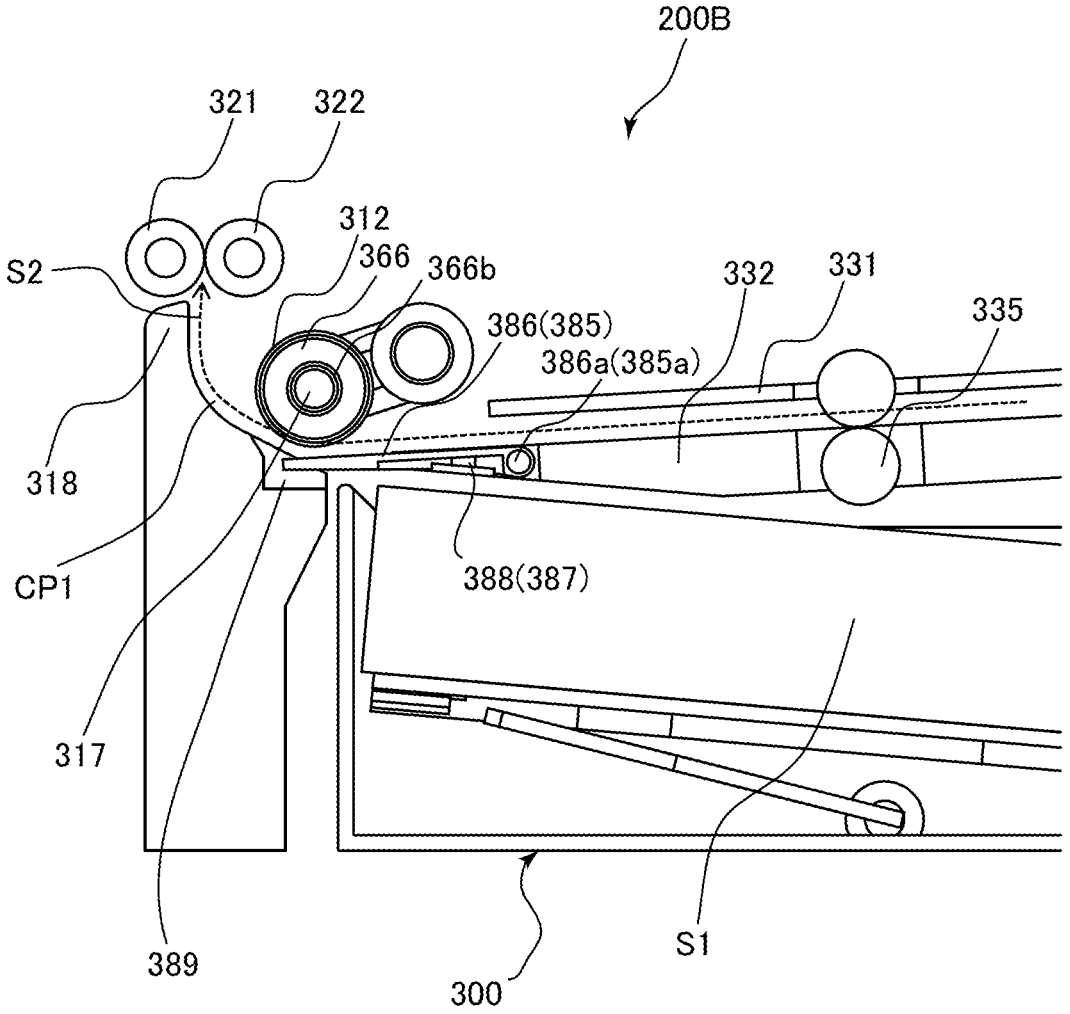
FIG. 8 is a side view illustrating a state in which a sheet is fed from a manual sheet conveyance path of the second exemplary embodiment.

These movable members 385 and 386 are provided to be movable between a retracting position as illustrated in FIG. 7 and a projecting position as illustrated in FIG. 8. Pressing members 387 and 388 are respectively disposed below the movable members 385 and 386, and are configured to press the movable members 385 and 386 from below. The movable members 385 and 386 are urged to the retracting position by the pressing members serving as urging portions.

The movable members 385 and 386 urged upward by the pressing members 387 and 388 are positioned at the retracting position as tips of the movable members 385 and 386 abut respectively with the abutment bosses 365*b* and 366*b* at the retracting position. The movable members 385 and 386 retract upward from the curved conveyance path CP1 at the retracting position and project to the curved conveyance path CP1 at the projecting position. In other words, the movable members 385 and 386 are positioned at the positions not overlapping with the curved conveyance path CP1 at the retracting position when viewed in the axial direction AD and are positioned at the positions overlapping with the curved conveyance path CP1 at the projecting position.

During the cassette feeding operation in which the sheet S1 is fed from the sheet feed cassette 300, the movable members 385 and 386 are held at the retracting position as illustrated in FIG. 7. Then, the sheet S1 is guided upward by the sheet guide 318 without coming into contact with the movable members 385 and 386.

Meanwhile, the sheet S2 that joins with the curved conveyance path CP1 by having passed through the manual conveyance path CP2 presses the movable members 385 and 386 to the projecting position by resisting against urging forces of the pressing members 387 and 388. Thereby, the movable members 385 and 386 enter a concave portion 389 created on the sheet guide 318, and the sheet S2 is smoothly guided to the sheet guide 318 by the movable members 385 and 386 positioned at the projecting position.

Here, the pressing members 387 and 388 are preferable to be able to press the movable members 385 and 386 as small force as possible within a range in which the pressing members 387 and 388 can urge the movable members 385 and 386 upward. This arrangement makes it possible to press the movable members 385 and 386 to the projecting position by resisting against the urging force of the pressing members 387 and 388 even if a sheet such a thin sheet having low rigidity is manually fed.

The sheet S2 being conveyed through the manual conveyance path CP2 slides on the movable members 385 and 386 positioned at the retracting position, and the leading edge thereof abuts with the feed roller 312, the movable members 385 and 386. After that, the sheet S2 is assumed to operate so as to press down the movable members 385 and 386 to the projecting position. In this case, if an angle θ formed between a tangential line of an outer circumference surface of the feed roller 312 at contact points of the sheet S2 and the conveyance rollers 365 and 366 and the upper surface of the movable members 385 and 386 is large, there is a possibility that the leading edge of the sheet S2 is damaged.

Due to that, according to the present exemplary embodiment, the retracting position of the movable members 385 and 386 is set such that the angle θ does not become large by abutting the tips of the movable members 385 and 386 with the abutment bosses 365*b* and 366*b*. In other words, the abutment bosses 365*b* and 366*b* serving as positioning portions position the movable members 385 and 386 positioned at the retracting position overlap with the conveyance rollers 365 and 366 when viewed in the axial direction AD. The angle θ is preferable to be 80 degrees or less. Then, because the movable members 385 and 386 are positioned accurately at the adequate retracting position, it is possible to reduce the damage otherwise given to the leading edge of the sheet S2.

OTHER EMBODIMENTS

It is noted that while the outer diameters D1 of the conveyance rollers 315, 316, 365 and 366 are set to be smaller than the outer diameter D2 of the feed roller 312 in any of the exemplary embodiments described above, the present disclosure is not limited to such configuration. For instance, the outer diameters D1 of the conveyance rollers 315, 316, 365 and 366 may be equal with the outer diameter D2 of the feed roller 312.

Still further, while the conveyance rollers 315, 316, 365 and 366 are disposed coaxially with the feed roller 312, the present disclosure is not limited to such configuration. For instance, the conveyance rollers 315, 316, 365 and 366 may be configured to be supported by a shaft other than the feed roller shaft 314 and so as to rotate centering on a rotational axis other than the feed roller 312.

Still further, while the pickup roller 311 is configured to be liftable in any of the exemplary embodiments described above, the present disclosure is not limited to such configuration. For instance, it is possible to arrange such that the uppermost sheet stacked on the sheet stacking plate 302 comes into contact or separates with/from the pickup roller 311 by lifting the sheet stacking plate 302. The sheet may be fed also by other rotary member such as a belt instead of the pickup roller 311.

Still further, while the printer 100 includes the sheet feed cassette 300 in any of the exemplary embodiments described above; the present disclosure is not limited to such configuration. For instance, it is also possible to arrange such that a user directly set sheets within a sheet storage space provided within the printer body 100A instead of using the sheet feed cassette 300.

Still further, while all of the exemplary embodiments described above have been described by using the electrophotographic type printer 100, the present disclosure is not limited to such configuration. For instance, the present disclosure is also applicable to an inkjet type image forming apparatus that is configured to form an image on a sheet by injecting ink droplets from a nozzle.

Still further, while one pair of movable members 385 and 386 has been provided in the second exemplary embodiment, the present disclosure is not limited to such configuration. For instance, the movable member may be one or three or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-119987, filed Jul. 13, 2020, which is hereby incorporated by reference herein in its entirety.

What is claimed is:

1. A sheet feeding apparatus comprising:

a sheet supporting portion configured to support a sheet;

a feed rotary member configured to feed the sheet supported by the sheet supporting portion;

a conveyance rotary member configured to convey the sheet fed by the feed rotary member;

a curved conveyance path that is curved upwardly and through which the sheet fed by the feed rotary member passes;

an upper conveyance path disposed above the sheet supporting portion to pass a sheet through and feeds the sheet to the curved conveyance path;

a first shaft;

a first driven rotary member rotatably supported by the first shaft and disposed inside of the curved conveyance path in a curved direction thereof, the first driven rotary member being driven to rotate by the sheet passing though the curved conveyance path;

a second shaft arranged spaced from the first shaft; and a second driven rotary member rotatably supported by the second shaft and disposed on a side opposite to the first driven rotary member across the conveyance rotary member in a rotation axial direction of the feed rotary member, the second driven rotary member being configured to be driven by the sheet passing through the curved conveyance path, wherein each of the first and second driven rotary members is separated from the conveyance rotary member in the rotation axial direction.

2. The sheet feeding apparatus according to claim 1, further comprising a separating portion configured to separate sheets one by one in the curved conveyance path.

3. The sheet feeding apparatus according to claim 1, wherein the first and second driven rotary members are disposed coaxially with the conveyance rotary member.

4. The sheet feeding apparatus according to claim 3, wherein:

the feed rotary member is provided swingably around a rotary axis of the conveyance rotary member between an abutment position where the feed rotary member comes into contact with the sheet supported by the sheet supporting portion and a separate position where the feed rotary member separates from the sheet supported by the sheet supporting portion, and a sheet conveyed through the upper conveyance path passes through between the feed rotary member positioned at the separate position and the sheet supported by the sheet supporting portion.

5. The sheet feeding apparatus according to claim 1, wherein each of outer diameters of the first and second driven rotary members is smaller than an outer diameter of the conveyance rotary member.

6. The sheet feeding apparatus according to claim 1, wherein the upper conveyance path is inclined downward toward a downstream side in a sheet conveyance direction.

7. The sheet feeding apparatus according to claim 1, wherein:

the curved conveyance path is formed by a curved guide member that comes into contact with a lower surface of the sheet and that guides the sheet upward, the upper conveyance path is formed by a first guide member and a second guide member disposed below the first guide member, and the sheet feeding apparatus further comprises a connection guide that is supported by the second guide member, extends downstream more than an upstream end, in a sheet conveyance direction, of the curved guide member and guides the sheet conveyed through the upper conveyance path to the curved guide member.

8. The sheet feeding apparatus according to claim 7, wherein:

the connection guide is movable between a retracting position where the connection guide is retracted from the curved conveyance path and a projecting position where the connection guide projects to the curved conveyance path, and the sheet feeding apparatus further comprises an urging portion configured to urge the connection guide to the retracting position.

9. The sheet feeding apparatus according to claim 8, further comprising a positioning portion configured to position the connection guide at the retracting position so as to overlap with the first and second driven rotary members as viewed in a rotation axial direction of the feed rotary member.

10. The sheet feeding apparatus according to claim 9, wherein the positioning portion is provided integrally with the first driven rotary member.

11. An image forming apparatus comprising:

the sheet feeding apparatus according to claim 1; and an image forming unit configured to form an image on a sheet fed from the sheet feeding apparatus.

* * * * *